United States Patent [19]

Lisiecki

[11] Patent Number: 4,931,031

[45] Date of Patent: Jun. 5, 1990

[54] METHOD FOR IMPROVED CONTAINER INTERNAL RAW EDGE PROTECTION

[75] Inventor: Robert E. Lisiecki, W. Bloomfield, Mich.

[73] Assignee: Elopak Systems AG, Glattbrugg, Switzerland

[21] Appl. No.: 373,406

[22] Filed: Jun. 30, 1989

[51] Int. Cl.[5] ..... B31B 1/16; B31B 1/25

[52] U.S. Cl. ..... 493/355; 493/60; 493/61; 493/62; 493/340; 493/354

[58] Field of Search ..... 493/58, 60, 340, 354, 493/355, 370, 59, 61, 62

[56] References Cited

U.S. PATENT DOCUMENTS 4,596,541 6/1986 Ward, Sr. ..... 493/60

4,708,708 11/1987 Fries, Jr. ..... 493/60

*Primary Examiner*—Frederick R. Schmidt

*Assistant Examiner*—Jack W. Lavinder

*Attorney, Agent, or Firm*—John P. Moran

[57] ABSTRACT

A method of forming a skived edge on the inside panel of a thermoplastic coated paperboard container, in part while the container is part of a web or sheet of paperboard material, and in part on individual blanks after being cut from the web or sheet. More specifically, a partial depth cut and an adjacent score line are formed on a carton converting machine providing a precise location for subsequently removing material and folding the edge of a blank on a side seam sealing machine.

4 Claims, 2 Drawing Sheets

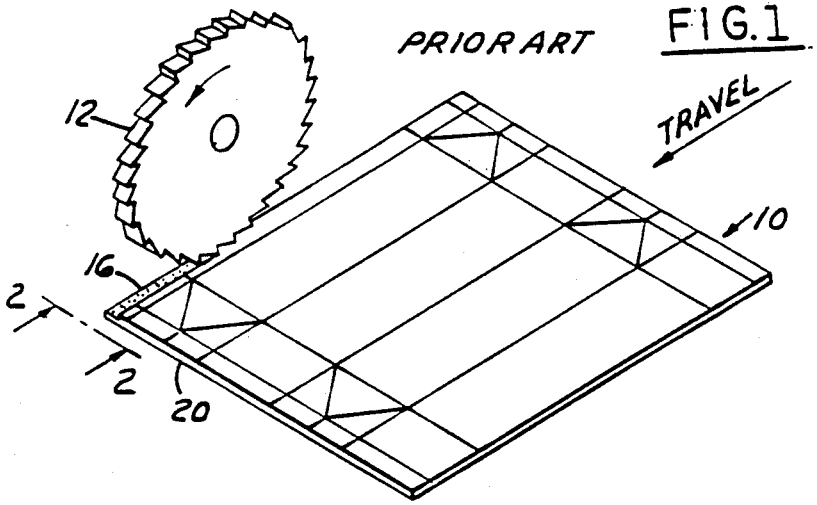
FIG.1
FIG.2
PRIOR ART
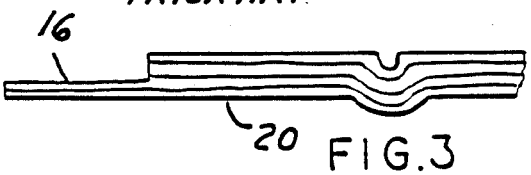
FIG.3
PRIOR ART
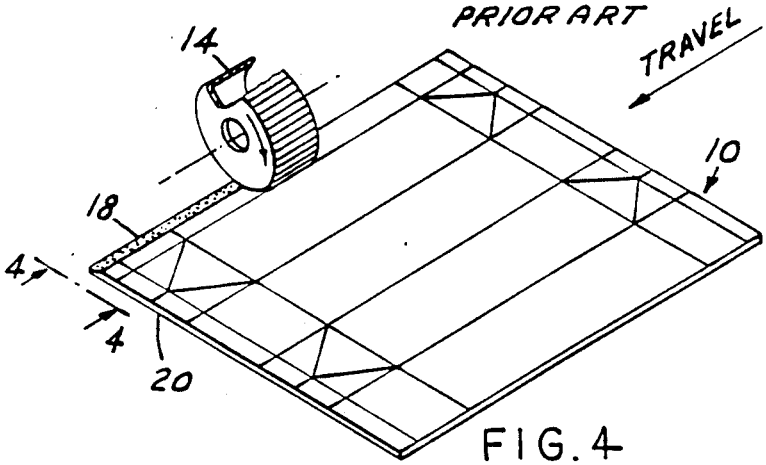
FIG.4
PRIOR ART
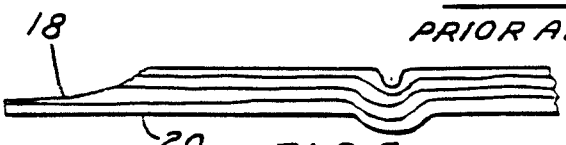
FIG.5
PRIOR ART
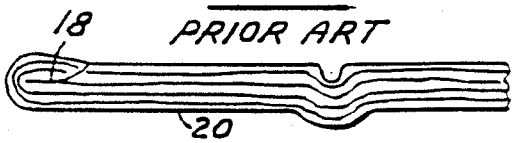

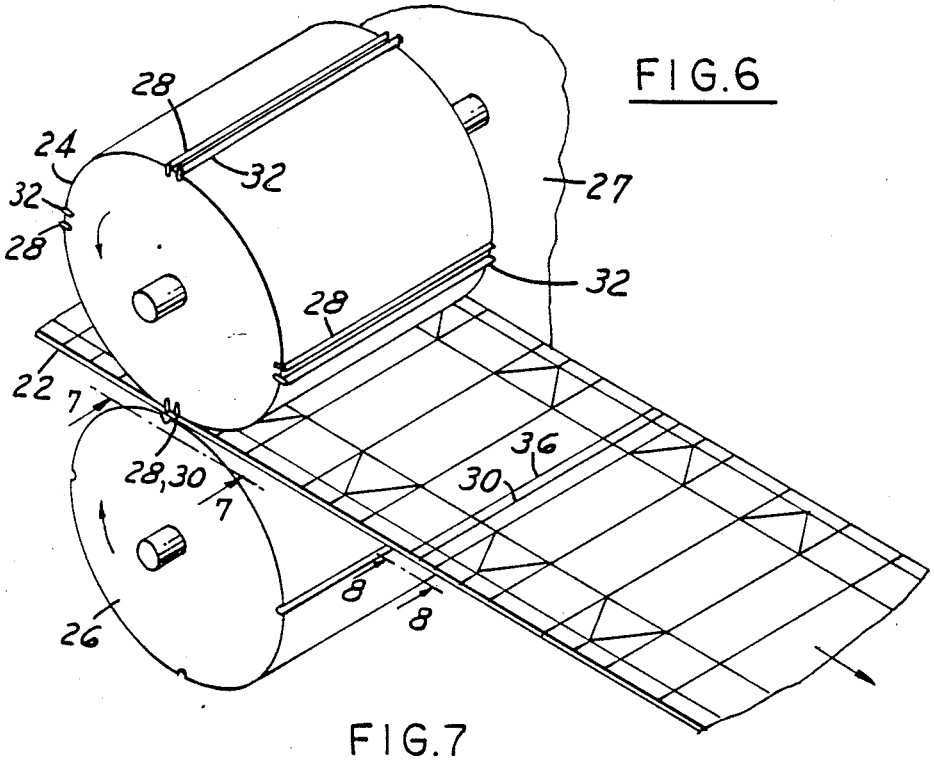
FIG.6
FIG.7
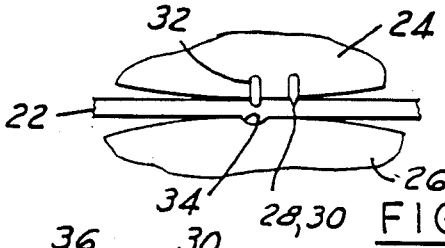
FIG.8
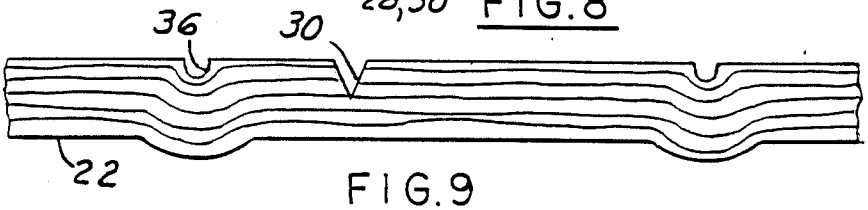
FIG.9
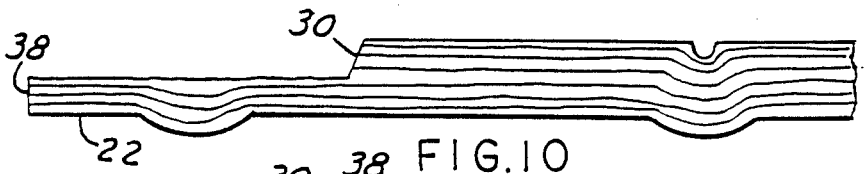
FIG.10
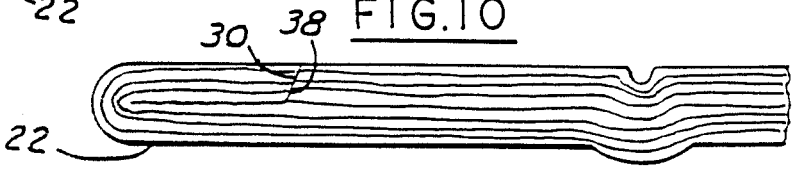

METHOD FOR IMPROVED CONTAINER INTERNAL RAW EDGE PROTECTION

TECHNICAL FIELD

This invention relates generally to a skiving arrangement for preparing a side seam flap of a thermoplastic coated paperboard container and, more particularly, to such an arrangement wherein a partial cut and related score line is made on the paperboard sheet or web while on the carton converting machine to assure a precision control of the skived edge when completed on the side seam sealing machine.

BACKGROUND ART

It is well known that internal free cut edges along this side seam panel or flap of a thermoplastic coated paperboard container are a serious problem in that the exposed paper fibers can absorb product or impart off-flavors to some products. One solution is skive and hem the internal cut edge of the side seam panel.

Typically, the entire skiving operation is accomplished on each container individual blank while being processed through the side seam sealing machine. For example, U.S. Pat. No. 3,604,317 discloses a cut edge formed partially through the blank thickness by a cutting knife a predetermined distance from a blank outer edge while the individual blanks are being fed through the side seal sealing machine. A skived area surface is then formed by a skiving milling blade serving to remove the material between the cut edge and the outer edge. The remaining material is then formed in such a manner that the skived area surface is folded across the cut edge and onto the adjacent outside surface.

U.S. Pat. Nos. 3,604,613 and 3,654,842 disclose side seam sealed containers, wherein approximately one-half the thickness of each container blank has been removed adjacent the edge of the side seam panel thereof. In 3,604,613 a fold line has been formed on the blank's inside surface along the center line of the skived area surface, while in 3,654,842 a notch has been formed on the skived surface itself along the center line thereof.

Inasmuch as the side seam sealing machine is a very high speed machine, it is very difficult to maintain the necessary accuracy and parallelism of the skived width and adjacent crease line with respect to the free edge of the blank.

DISCLOSURE OF THE INVENTION

Accordingly, it is a general object of the invention to provide an improved skiving method which will markedly improve the accuracy and parallelism of the skived area surface, resulting in an improved hem on the internal side seam panel or flap.

Another object of the invention is to provide an improved skiving method wherein a first step of the process is accomplished on the carton converting machine while the paperboard is still in sheet or web form to assure a precision control of the skived edge when it is complete on the side seam sealing machine.

A further object of the invention is to provide a skiving method wherein a pre-skiving partial cut and an adjacent cooperating score line are formed at predetermined locations in register with the other longitudinal and lateral score lines formed on the sheet or web prior to the latter being cut into individual container blanks.

These and other objects and advantages of the invention will become more apparent when reference is made to the following drawings and related description.

BRIEF DESCRIPTION OF THE DRAWINGS

FIGS. 1 and 3 are perspective views of prior art operations for skiving the edges of paperboard container blanks;

FIGS. 2 and 4 are fragmentary end views of typical results of the FIGS. 1 and 3 operations, as taken along the planes of the lines 2—2 and 4—4 of FIGS. 1 and 3, respectively, and looking in the direction of the arrows;

FIG. 5 is a view similar to FIGS. 2 and 4, illustrating the end results of the hemming operation performed on the blanks of FIG. 2 or 4;

FIG. 6 is a perspective view of an operation in accordance with the inventive method, being performed on a sheet or web of the thermoplastic coated paperboard;

FIG. 7 is an enlarged fragmentary end view taken along the plane of the line 7—7 of FIG. 6 and looking in the direction of the arrows;

FIG. 8 is an enlarged fragmentary end view of the web portion of FIG. 6, taken along the plane of the line 8—8 of FIG. 6, and looking in the direction of the arrows; and FIGS. 9 and 10 are enlarged fragmentary end views illustrating further operations performed on the container blanks after being cut from the sheet or web of FIG. 6.

BEST MODE FOR CARRYING OUT THE INVENTION

Referring now to the drawings in greater detail, FIGS. 1-5 represent typical prior art skiving arrangements involving individual thermoplastic coated paperboard blanks 10, and conventionally performed on the side seam sealing machine as shown and described in U.S. Pat. No. 3,604,317, issued on Sept. 14, 1971. The typical result of the toothed roller 12 method of FIG. 1 and the cup-shaped wheel 14 method of FIG. 3 are approximately as shown in FIGS. 2 and 4, respectively, as skived edges 16 and 18. Typically, in a further operation, the skived edge 16 or 18 is folded over onto itself, as shown in FIG. 5, such that the inside surface 20 of the blank 10 no longer exposes a raw edge.

Referring now to FIG. 6, there is illustrated a web or sheet 22 of the thermoplastic coated paperboard material continuously moving through the adjacent rollers 24 and 26 incorporated in the conventional carton converting machine, represented at 27, prior to individual blanks being cut from the web or sheet and entering the side seam sealing machine referred to above. It is to be realized that the typical carton converting machine, such as shown and described in U.S. Pat. No. 2,692,208, is adapted to receive thermoplastic coated paperboard stock in roll form and to unwind same in a continuous moving web, to print advertising or indentifying indicia on the stock, to score same in order to facilitate folding during erection of the cartons, and finally to cut and separate individual blanks from the web.

The particular printing unit, scoring rolls, cutting rolls, and separating and stacking means are not a part of the present invention and, hence, are not shown herein, but are fully shown and described in U.S. Pat. No. 2,692,208, incorporated herein by reference.

The upper roller 24, which may be one of the conventional rollers on the carton converting machine, or may be one of a separate pair of roller thereon, includes one or more cutting blades 28, for forming a V-shaped notch 30 (FIG. 7) in the sheet 22 depending upon the size of the roller relative to the size of the blanks which are to be cut from the web 22. The blades 28 form partial cuts in the form of V-shaped notches at spaced internals along the width of the web 22, as better seen in FIG. 8. The rollers 24 and 26 also include spaced laterally extending ribs 32 and recesses 34 respectively, for forming a score line 36 at approximately the half-way point between the notch 30 and what is to be cut as the edge 38 (FIG. 9) of the blank downstream of the notch 22 and score line 36 forming operation.

By forming the partial cut or substantially V-shaped notch 30 and the adjacent score line 36 on the converter, a precision control is established as a basis for the skived area in a manner which is not possible on the side seam sealing machine.

After the blanks have been cut from the sheet or web 22 and leave the carton converting machine, the material between the edge 38 and the notch 30, of approximately one-half the thickness of the paperboard, as may be noted in FIG. 9, is then removed on the side seam sealing machine by any suitable means, such as the toothed roller 12 of FIG. 1, or the cup-shaped wheel 14 of FIG. 3. The skived end portion is then folded in half, i.e., the portion between the free cut edge 38 and the score line 32 is folded onto the portion between the score line 32 and the remaining side of the original notch 30, as shown in FIG. 10.

INDUSTRIAL APPLICABILITY

It should be apparent that, having first formed the V-shaped notch on the web or sheet on the carton converting machine, in registry with all the other score lines formed thereon, the subsequent skiving operation on the side seam sealing machine will more readily follow and be limited by the remaining side of the notch which serves as a wall or abutting edge therefor.

While but one embodiment of the invention has been shown and described, other modification thereof are possible within the scope of the following claims.

The embodiments of the invention in which an exclusive property or privilege is claimed are described as follows:

1. A method of skiving the edge of a predetermined panel of container blanks cut from a web of thermoplastic coated paperboard, said method comprising the steps of:

(a) Continuously moving said web of thermoplastic coated paperboard in a longitudinal direction between a pair of spaced apart oppositely rotating rollers;

(b) Forming spaced apart partial cuts and score lines transverse to said longitudinal direction into and across each blank on said web with cutting edges and ribs located at predetermined locations on one of said rollers during the rotation of said rollers while said web is moving therebetween;

(c) Cutting said blanks from said web at predetermined locations with respect to said partial cuts, forming free cut edges thereon; and (d) Processing individual blanks cut from the web by removing material of approximately one-half the thickness of the blank between the partial cut and the adjacent free cut edge of each blank wherein the score lines are formed parallel to each of said partial cuts a predetermined distance therefrom and intermediate said respective partial cuts and said adjacent free cut edges.

2. The method of skiving described in claim 1, wherein the numbers of cutting edges and associated ribs are selected in accordance with the size of the blanks to be formed relative to the size of the rollers.

3. The method of skiving described in claim 1, wherein continuously moving said web of thermoplastic coated paperboard between a pair of spaced apart oppositely rotating rollers is between such rollers mounted on a carton converting machine.

4. The method of skiving described in claim 1, and folding the edge portion of the blank about said score line intermediate the partial cut and the adjacent free cut edge onto the portion between said score line and said partial cut.

* * * * *